US005485991A

United States Patent [19]

Hirano et al.

[11] Patent Number: 5,485,991

[45] Date of Patent: Jan. 23, 1996

[54] AUTOMATIC SHEET FEEDING APPARATUS

[75] Inventors: Hirofumi Hirano; Koh Hasegawa, both of Yokohama; Hiroyuki Inoue, Chiba; Toshihiko Bekki, Kawasaki; Masaharu Ikado, Yokohama, all of Japan

[73] Assignee: Canon Kabushiki Kaisha, Tokyo, Japan

[21] Appl. No.: 330,609

[22] Filed: Oct. 28, 1994

Related U.S. Application Data

[63] Continuation of Ser. No. 932,217, Aug. 19, 1992, abandoned.

[30] Foreign Application Priority Data

Aug. 21, 1991 [JP] Japan ..... 3-209475
Aug. 21, 1991 [JP] Japan ..... 3-209482

[51] Int. Cl.[6] ..... B65H 3/54; G03G 15/00

[52] U.S. Cl. ..... 271/121; 271/109; 271/117; 271/119; 271/169; 271/167

[58] Field of Search ..... 271/117, 119, 271/121, 167, 169, 109

[56] References Cited

U.S. PATENT DOCUMENTS

| | | | |
|---|---|---|---|
| 4,773,782 | 9/1988 | Hirano . | |
| 4,822,023 | 4/1989 | Miyoshi | 271/167 X |
| 5,026,042 | 6/1991 | Miller | 271/121 X |
| 5,090,679 | 2/1992 | Maekawa et al. | 271/121 X |
| 5,120,042 | 6/1992 | Goto et al. | 271/121 X |

FOREIGN PATENT DOCUMENTS

| | | | |
|---|---|---|---|
| 2263468 | 12/1972 | Germany . | |
| 3211371 | 3/1982 | Germany . | |
| 3508270 | 9/1986 | Germany | 271/121 |
| 55-44474 | 3/1980 | Japan . | |
| 55-44473 | 3/1980 | Japan . | |
| 55-44472 | 3/1980 | Japan . | |
| 244733 | 12/1985 | Japan | 271/121 |
| 62-264140 | 11/1987 | Japan . | |
| 196432 | 8/1988 | Japan | 271/121 |
| 214541 | 8/1989 | Japan | 271/121 |
| 288536 | 11/1989 | Japan | 271/121 |
| 193834 | 7/1990 | Japan | 271/121 |

*Primary Examiner*—William E. Terrell
*Assistant Examiner*—Luong Nguyen
*Attorney, Agent, or Firm*—Fitzpatrick, Cella, Harper & Scinto

[57] ABSTRACT

The present invention provides an automatic sheet feeding apparatus comprising sheet supporting means for supporting a plurality of sheets, sheet supply means for feeding out the sheets supported by the sheet supporting means, separation means for separating the sheets one by one by abutting the sheet against the separation means and by riding one of the sheets over the separation means, and flexion permitting means for causing the sheet supply means not to apply the load to the flexion of the sheet produced when the sheet is riding over the separation means.

27 Claims, 13 Drawing Sheets

AUTOMATIC SHEET FEEDING APPARATUS

This application is a continuation of application Ser. No. 07/932,217 filed Aug. 19, 1992 abandoned.

BACKGROUND OF THE INVENTION

1. Field of the Invention

The present invention relates to an automatic sheet feeding apparatus for feeding a recording sheet to a recording system or a copying machine, and for successively feeding originals to an image reading system and the like.

2. Related Background Art

In the past, as automatic sheet feeding apparatus for successively feeding stacked recording sheets or originals (referred to generically as "sheets" hereinafter) one by one to a recording system or an image reading system, the following three types have been well used.

A sheet feeding apparatus of the first type, which has been most widely used, is of the claw separation type, an example of which is shown in FIG. 28. This apparatus comprises a pair of substantially triangular separating claws 101 associated the front corners of stacked sheets 100, a pair of sheet supply rollers 102 (only one of which is shown) abutted against an upper surface of the sheet stack and adapted to feed the sheets 100 downwardly, a sheet supply roller shaft 103, a pressure plate 104 for urging the sheet stack 100 against the sheet supply rollers 102, a spring (not shown) for biasing the pressure plate 104 upwardly, separation sheets 105 adapted to prevent double-feed of the sheets 100 and adhered to the pressure plate 104 in confronting relation to the sheet supply rollers 102, and a sheet cassette 106. This apparatus is designed so that the sheets are separated one by one by creating a loop in the sheet by making good use of the resilience of the sheet (resistance to the bending of the sheet) to ride the sheet over the separating claws 101.

A sheet feeding apparatus of the second type is of the friction separation type, an example of which is shown in FIG. 29. This apparatus comprises a separation roller 102 having a relatively large diameter, a separation roller shaft 103, a separation pad 107 urged against the separation roller 102, a spring (not shown) for biasing the separation pad 107 upwardly, a feed roller 108 for feeding sheets 100 intermittently, and a pinch roller 109. This apparatus is designed so that the sheets are separated by using a friction force.

A sheet feeding apparatus of the third type is of the so-called bank separation type, an example of which is shown in FIG. 30. In this apparatus, a bank 110 having a ramp surface included at an appropriate angle is disposed at a downstream side of a sheet stack 100 in a sheet feeding direction, and the sheets 100 are separated one by one by bending the top sheet 100*a* along the ramp surface of the bank 110 by a feeding force of sheet supply rollers 102 against which the sheet stack 100 is urged by a pressure plate 104 and a pressure plate spring 111.

However, the above-mentioned sheet separating techniques have the following drawbacks.

First, in the sheet feeding apparatus of the claw separation type, the sheets are separated by bending the front corner portions of the sheet to form a loop by the separating claws 101. Thus, it is difficult to form the loop, and, thus, to separate thicker sheets such as post cards, envelopes and the like which are hard to be bent. Further, relatively thin sheets have less resilience. Thus, loops are formed on a plurality of sheets simultaneously and, thus, it is difficult to separate the sheets one by one. Further, even for sheets having a normal thickness, under high temperature and high humidity circumstances, the sheets absorb moisture to weaken their resilience, and two or more sheets can be separated simultaneously, similar to the aforementioned drawback as to thin sheets.

In addition, a feeding force of the sheet supply rollers 102 must be increased to form the loop in the sheet. Since the separation pads 105 are formed on the pressure plate 104 under the sheet stack 100 to generate a predetermined friction force for preventing double-feed of the sheets (the last two sheets are fed simultaneously), when no sheet is present, the sheet supply rollers 102 are slidingly contacted with the separation pads 105 directly, thereby increasing the load. Thus, a motor having greater torque is required. Further, since a space for accommodating the loop of the sheet is required above the separating claws 101, the size of apparatus becomes large.

In the sheet feeding apparatus of the friction separation type, the sheets are separated by the squeezing action of the friction pad 107 and the separation roller 102. Thus, the apparatus has greater freedom as to the range of thickness of the sheet to be used, for example, from normal copying sheets to post cards. However, the ability for separating thin sheets is unstable, and the diameter of the separation roller 102 must be relatively large, thus the size of the apparatus must be increased. Further, the lower sheet cannot be separated unless the separation pad 107 is always contacted with the separation roller 102. Thus, even after a sheet is fed, the separation roller 102 must be rotatingly driven, with the result that the separation roller 102 is always subjected to a rotational load. Thus, a motor having greater torque is required.

Further, in a printing system, when a trailing edge of the sheet leaves the separation roller, the variation in load causes uneven feeding of the sheet, thereby decreasing the image quality. In addition, the sheets are separated at their leading edge portions. Thus, an additional means is required for abutting the sheet 100 against a nip between the separation roller 102 and the separation pad 107, and, therefore, the feeding means 108, 109 must be arranged at an upstream side or another pad capable of being contacted with and separated from the separation roller 102 must be arranged, thus making the apparatus complicated, large and expensive.

In the sheet feeding apparatus of the bank separation type, although the construction thereof is relatively simple, since the resilience of the sheet is utilized to separate the sheets, it is difficult or impossible to separate sheets other than post cards and other sheets having the same thickness as that of a post card (having the same resilience as that of a post card); therefore, such bank separation technique cannot be used with sheet feeding apparatuses other than an automatic sheet feeding apparatus for thicker sheets such as a post card feeder.

In this way, none of the above-mentioned three separation types can reliably separate various sheets from thin sheets to thicker sheets such as post cards, envelopes and the like, and, thus, the permissible kinds of sheets to be separated are limited. Accordingly, in order to treat sheets having various thickness, since the above-mentioned three separation types must be combined and be switched to treat the respective sheets, or the sheet feeding apparatus must be replaced to cope with sheets having a specific thickness, not only the operability is deceased but also the system becomes expensive and large.

SUMMARY OF THE INVENTION

An object of the present invention is to solve the above-mentioned conventional drawbacks. In order to achieve this, the present invention provides an automatic sheet feeding apparatus comprising sheet supporting means for supporting a plurality of sheets, sheet supply means for feeding out the sheets supported by the sheet supporting means, separation means for separating the sheets one by one by abutting the sheet against the separation means and by riding one of the sheets over the separation means, and flexure permitting means for causing the sheet supply means not to apply a load to the flexure of the sheet produced when the sheet is riding over the separation means.

Further, means form tiltably supporting the separation means may be provided to change the inclination of the separation means in accordance with the stiffness of the sheet.

With the arrangement as mentioned above, since the formation of the flexure of the sheet effected when the sheet is riding over the separation means against which the sheets are abutted is not regulated by the sheet supply means, it is possible to reliably separate the sheets by a single construction or structure, regardless of the stiffness of the various sheets.

Further, since the inclination of the separation means can be changed in accordance with the stiffness of the sheets, in the case of thin sheets, by decreasing the inclination of the separation means, it is possible to reliably separate the thin sheets one by one. On the other hand, in the case of thicker sheets, by increasing the inclination of the separation means so that each sheet can ride over the separation means with less flexure, it is possible to reduce the feeding force of the sheet supply means.

DETAILED DESCRIPTION OF THE PREFERRED EMBODIMENT

The present invention will now be explained with reference to the accompanying drawings.

Figure 1:
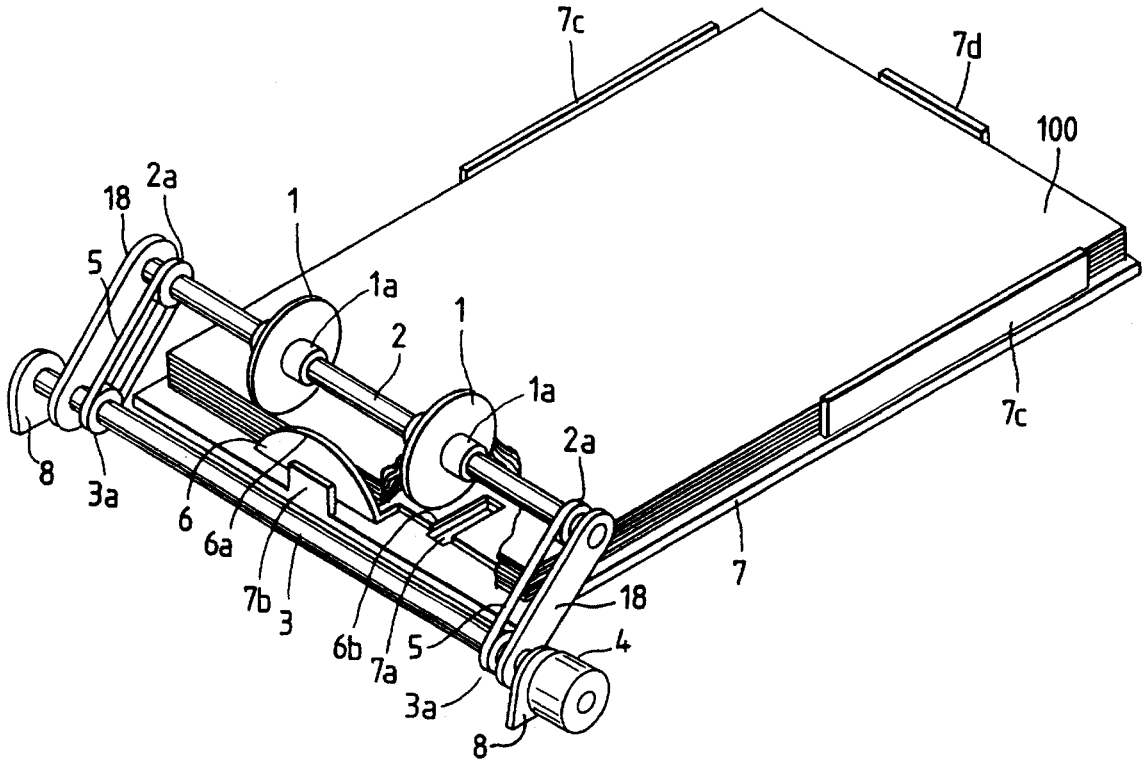
FIG. 1 is a perspective view of an automatic sheet feeding apparatus according to a first embodiment of the present invention.
Figure 2:
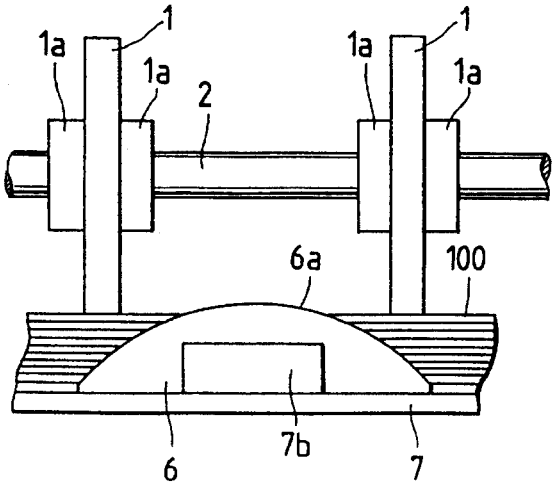
FIG. 2 is an end elevational view of a portion of the apparatus of FIG. 1.
Figure 3:
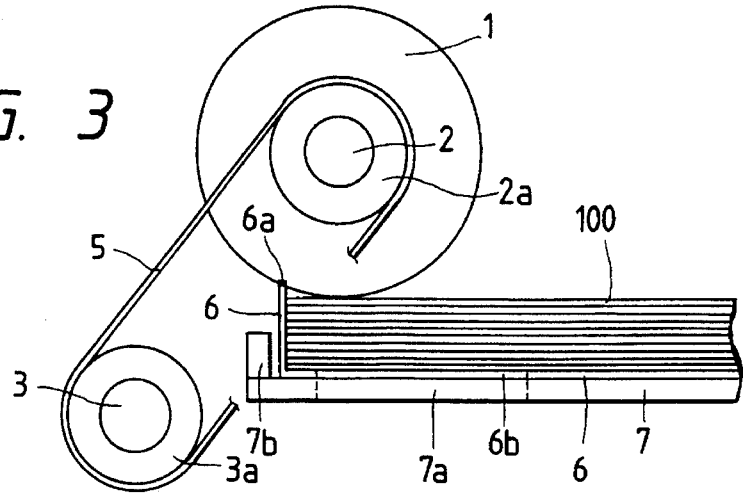
FIG. 3 is a side elevational view of a portion of the apparatus of FIG. 1.

FIG. 1 is a perspective view of a sheet feeding apparatus according to a first embodiment of the present invention, FIG. 2 is a partial end elevational view of the apparatus of FIG. 1, and FIG. 3 is a partial side elevational view of the apparatus of FIG. 1.

In FIGS. 1 to 3, each of two sheet supply rollers 1 is formed as a thin disk made of material having a high coefficient of friction (for example, rubber, polyurethane foam or the like) so that it may easily deform in an axial direction of the roller. Further, each sheet supply roller 1 has a central boss la formed integrally therewith to be connected to a roller shaft 2. The roller shaft 2 on which the sheet supply rollers 1 are secured at predetermined positions is supported in such a manner that a position of this shaft in a thrust direction is regulated by thrust bearings (not shown). Pulleys 2*a* are secured to respective ends of the roller shaft 2. Driving pulleys 3*a* are secured to respective ends of a transmission shaft 3, which is rotatably supported by bearings 8. Belts 5 are wound around and extend between the respective pulleys 2*a* and corresponding driving pulleys 3*a*, to transmit the rotation of the transmission shaft 3 to the roller shaft 2. Each belt 5 may comprise a timing belt or a flat belt. A motor 4 is rigidly connected to the transmission shaft 3 and preferably comprises a stepping motor because the rotation of the motor in normal and reverse directions can easily be controlled. By selecting the rotational direction of the motor 4, the transmission shaft 3 can be rotated in a normal direction or a reverse direction. Further, the roller shaft 2 is supported by rocker arms 18 pivotable around the transmission shaft 3 so that the roller shaft 2 can be rotated and revolved around the transmission shaft 3.

A separation plate 6 having a semi-cylindrical end surface 6*a* is formed as a thin plate made of elastic material such as a polyester sheet or the like. The separation plate 6 is disposed between the sheet supply rollers 1, and is also arranged at a downstream side of contact areas between the sheet supply rollers 1 and a sheet 100 so that the separation plate extends in parallel with a line connecting the left and right contact areas of the sheet supply rollers 1 (to the sheet). The separation plate 6 is attached to a sheet deck 7 and is provided with two slits 6*b* (one of which is not shown in FIG. 1) in confronting relation to the sheet supply rollers 1. The sheet deck 7 serves to stack the sheets 100 thereon and to regulate the position of the sheet stack.

The sheet deck 7 is provided with openings 7*a* (one of which is not shown in FIG. 1) aligned with the slits 6*b* of the separation plate 6. A stopper 7*b* having a predetermined width is integrally formed with the sheet deck 7 and is disposed at a downstream side of the separation plate 6. The width of the stopper is preferably smaller than the contour of the separation plate so as not to interfere with a sheet separated by the separation plate. Further, the stopper 7*b* is disposed behind the separation plate 6 with a small gap therebetween and has a height less than that of the separation plate. Thus, when the separation plate 6 is abutted against the stopper 7*b*, it is stopped by the stopper at a predetermined inclined position. Side guides 7*c* and an end guide 7*d* serve to regulate the lateral edges and the trailing edge of the sheet stack, respectively.

Next, an operation of the sheet feeding apparatus according to the illustrated embodiment will be explained with reference to FIGS. 4 to 10.

Figure 4:
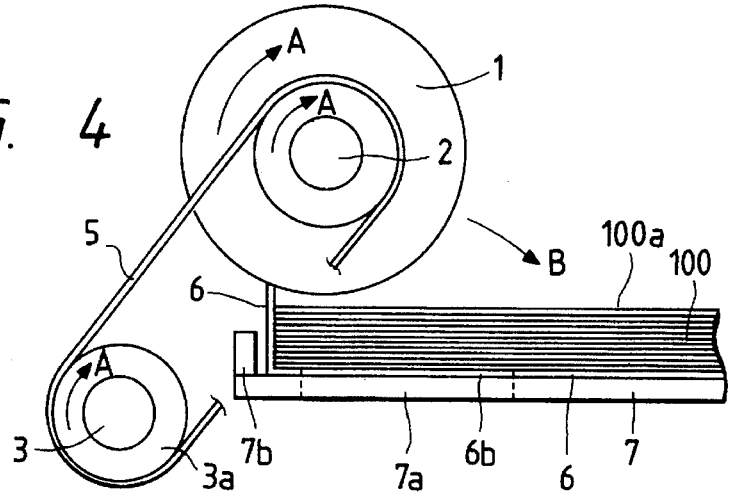
FIG. 4, 5 and 6 are partial side elevational views for explaining an operation of the apparatus of FIG. 1.
Figure 7:
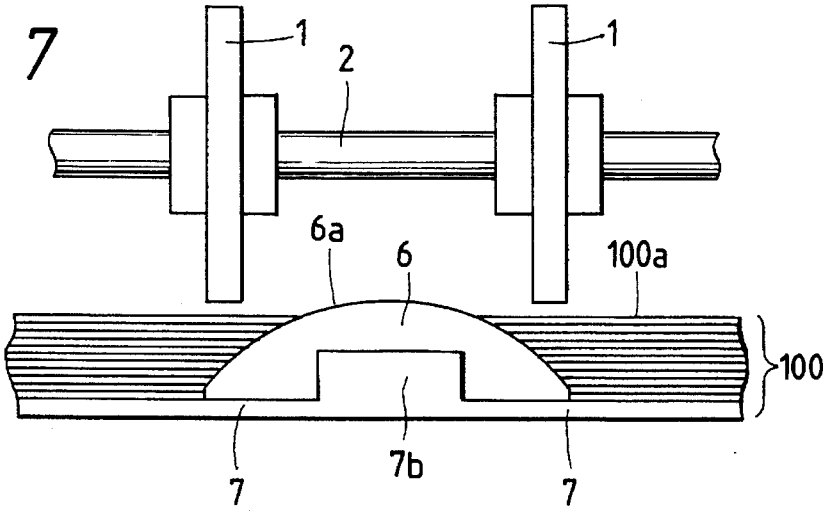
FIG. 7, 8 and 9 are partial and elevational views for explaining an operation of the apparatus of FIG. 1.
Figure 8:
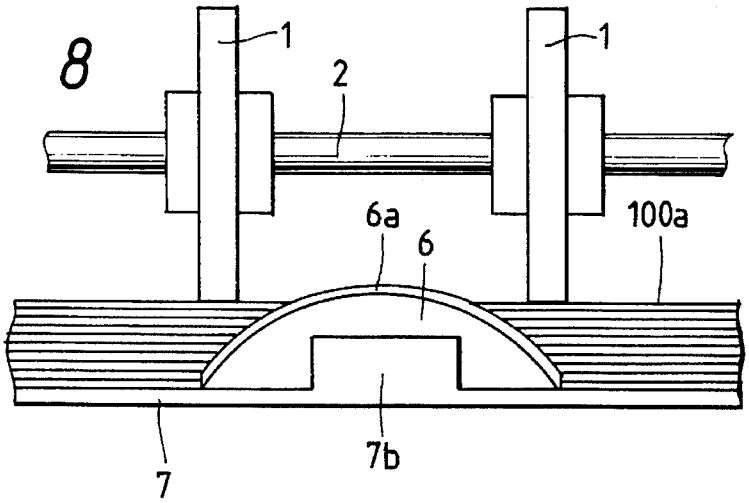

First, in FIGS. 4 and 7, when the motor 4 is rotated in a direction shown by the arrow A, the transmission shaft 3 and the driving pulleys 3*a* are rotated in the same direction A. Further, the belts 5 and the pulleys 2*a* are also rotated in the same direction as that of the motor 4, thus rotating the roller shaft 2 in the same direction A. Accordingly, the sheet supply rollers are rotated in the direction A and are also revolved around transmission shaft 3 in a direction shown by the arrow B (i.e., direction that the sheet supply rollers are abutted against the sheet stack 100) by the rotation of the transmission shaft 3.

Figure 5:
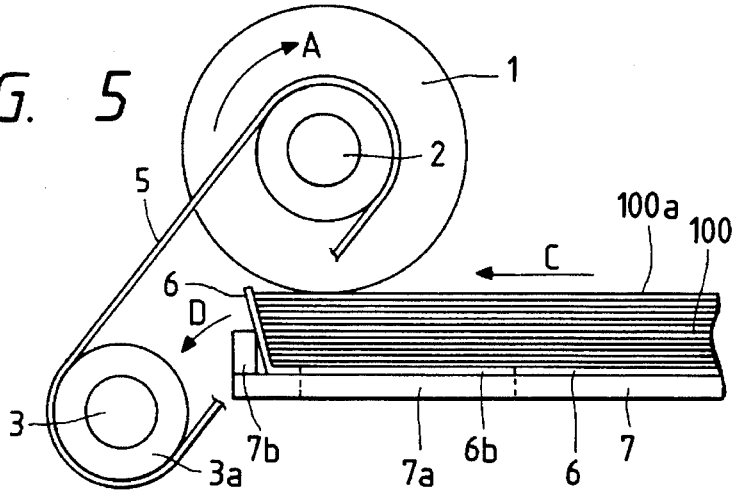

The sheet supply rollers 1 are against an uppermost sheet 100*a* on the sheet stack 100 and feed out the sheet stack in a direction shown by the arrow C (FIG. 5). The sheet stack 100 is [bodily] shifted as a whole to push the separation plate 6. As a result, the separation plate 6 is rotated in a counterclockwise direction (shown by the arrow D) until it is abutted against the stopper 7*b*. Since the sheets other than the uppermost sheet 100*a* are pushed in the direction C by the friction force between the sheets, these sheets are stopped when they are abutted against the separation plate 6 (see FIGS. 5 and 8).

Figure 6:
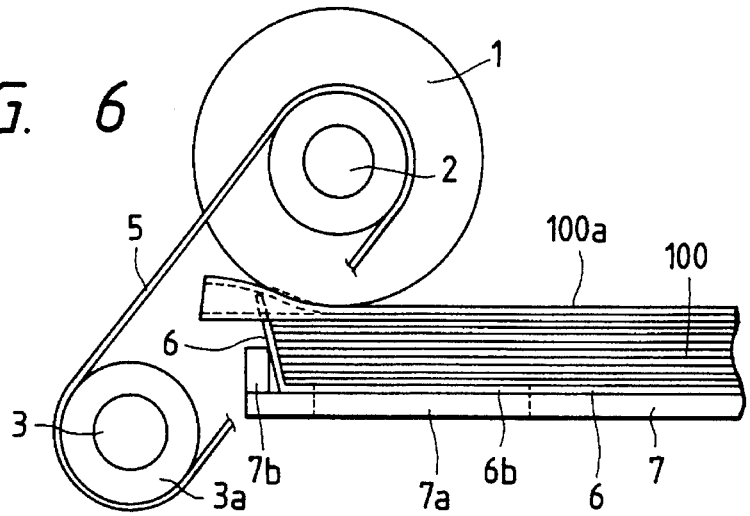
Figure 9:
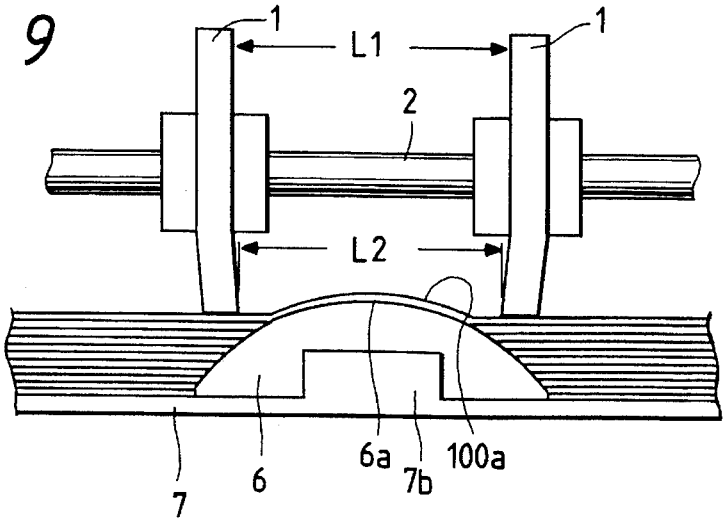

When the sheet supply rollers 102 are further rotated to try to feed the uppermost sheet 100*a* in the direction C, since portions of the uppermost sheet 100*a* which are abutted against the separation plate 6 cannot be deformed due to the resilience of the sheet, the uppermost sheet is deformed to bend upwardly near a central portion of the separation plate 6, thereby trying to ride over the separation plate (see FIG. 6 and 9). In this case, the uppermost sheet 100*a* pulls the sheet supply rollers 1 inwardly by an amount corresponding to the deformation of the sheet. Such amount depends upon the configuration of the end surface 6*a* of the separation plate 6, and is (L1–L2) in FIG. 9. Now, since the sheet supply rollers 1 have a plate-like shape, they are easily deformed inwardly, thereby not preventing the uppermost sheet 100*a* from riding over the separation plate 6. Accordingly, in this case, the sheet supply rollers 1 are pulled inwardly to deform by a tension force of the sheet 100*a*.

Figure 10:
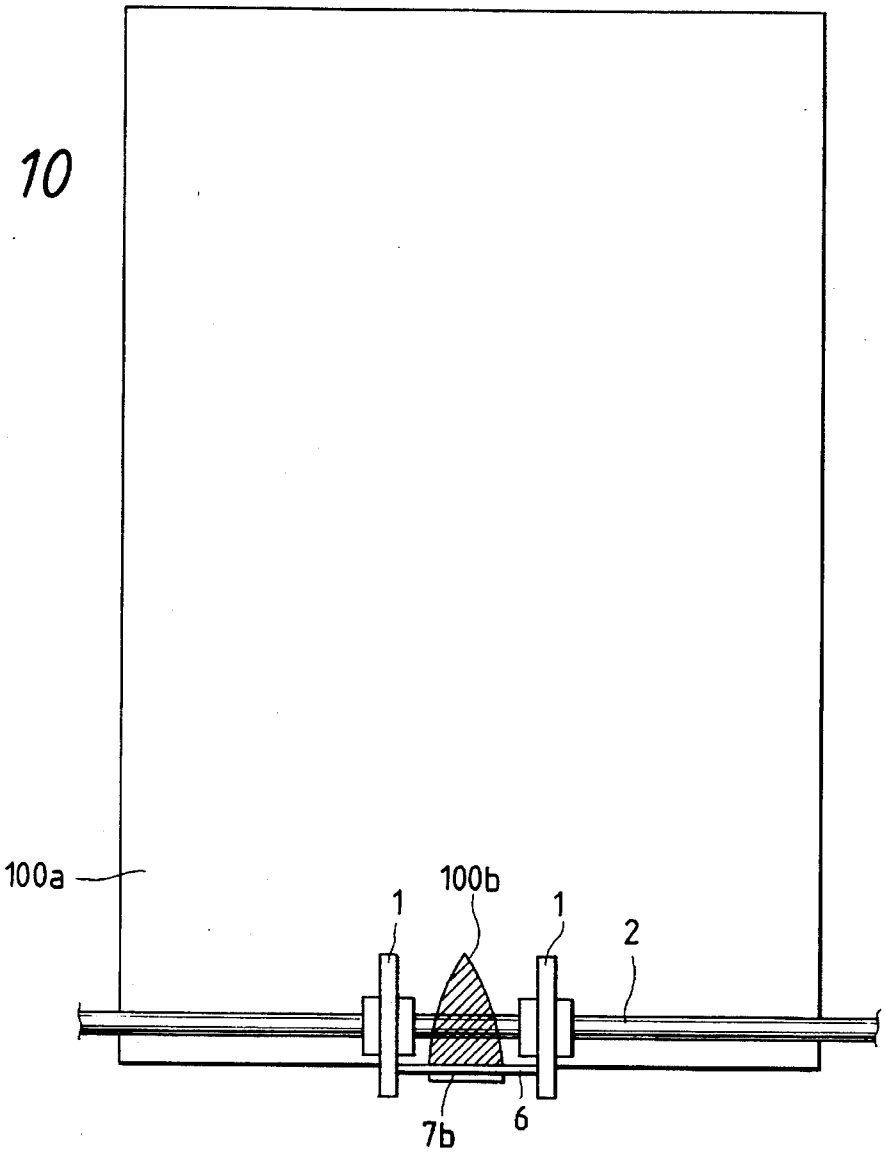
FIG. 10 is a plan view showing the deformation of a sheet caused when the sheet is separated from the other sheets by the apparatus of FIG. 1.

The deformation of the uppermost sheet 100*a* in this case occurs locally, and, as shown in FIG. 10, the deformation is formed between the sheet supply rollers 1 as a swelling portion (shown by a hatched area 100*b*) of substantially triangular shape having the base corresponding to the separation plate 6 and two arcuate oblique sides or legs. Since the deformation is created by the feeding force of the sheet supply rollers 1 and the tension force of the sheet 100*a* itself, by appropriately selecting the shape of the separation plate 6, no deformation is created in the underlying sheets. After the uppermost sheet 100*a* alone has been separated, the separated sheet is directed to downstream main feed rollers (not shown). Thereafter, the motor 4 is reversely rotated in a direction opposite to the direction A, and the condition shown in FIG. 4 is restored. In this way, a sheet separating and feeding cycle is completed.

In the position shown in FIG. 4, even when the motor 4 is stopped, roller shaft 2 remains in position by a click member or holder member (not shown).

Figure 11:
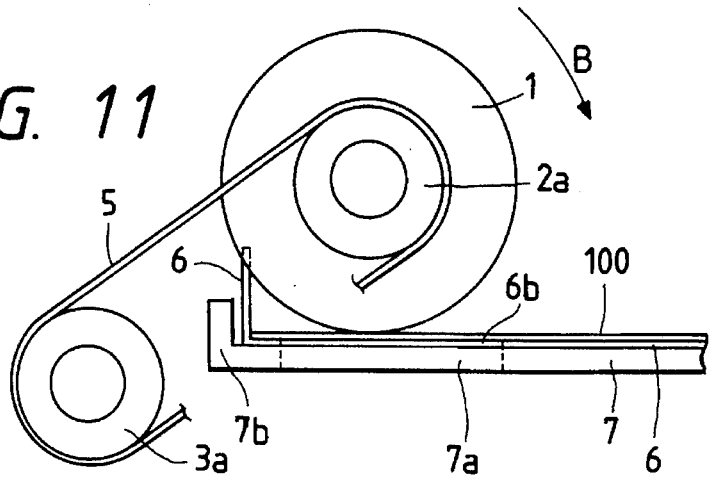
FIGS. 11 and 12 are partial side elevational views for explaining an operation of the apparatus of FIG. 1.

When the number of remaining sheets becomes few by repeating the cycle of separating and feeding the sheets, as shown in FIG. 11, the sheet supply rollers 1 are revolved by greater angle toward the sheet stack, whereby the sheet supply rollers 1 are revolved by greater angle toward the sheet stack, whereby the sheet supply rollers are further spaced apart from the separation plate 6. Further, a contacting area (line) between the separation plate 6 and the uppermost sheet 100*a* becomes greater and a larger loop must be formed in the uppermost sheet to ride over the separation plate. However, since the distance between the sheet supply rollers 1 and the separation plate 6 becomes longer, the sheet can be deformed more easily so that a larger loop can be formed by the same feeding force (of the sheet supply rollers) as the feeding force for the aforementioned first uppermost sheet. In this case, the positional relation between the transmission shaft 3 and the roller shaft 2, and the separating mode can be appropriately selected or set.

Figure 12:
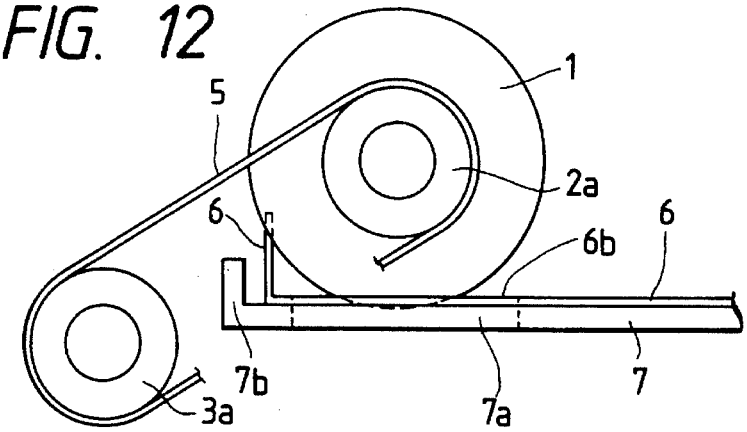

FIG. 12 shows a condition that there is no sheet on the sheet deck. In this case, the sheet supply rollers 1 slightly penetrate into the slits 6*a* of the separation plate 6 and the openings 7*a* of the sheet deck 7, and the movement of the roller shaft 2 is prevented by a stopper (not shown). Thus, when there is no sheet, since the sheet supply rollers 1 can be idly rotated, it is possible to prevent an excessive load from acting on the motor.

Figure 13:
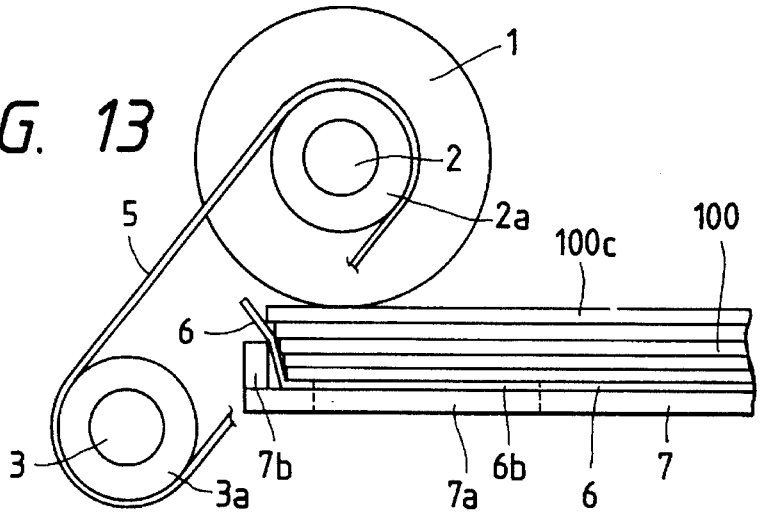
FIGS. 13 is a partial side elevational view showing a condition that thicker sheets are separated by the apparatus of FIG. 1.

On the other hand, as shown in FIG. 13, when thicker sheets such as post cards and the like are used, since the separation plate 6 is greatly deformed above the stopper 7*b*, the loop formed in the thicker sheet may be smaller to ride over the separation plate, whereby an increase in the feeding force of the sheet supply rollers is not required.

Next, a second embodiment of the present invention will be explained.

Figure 14:
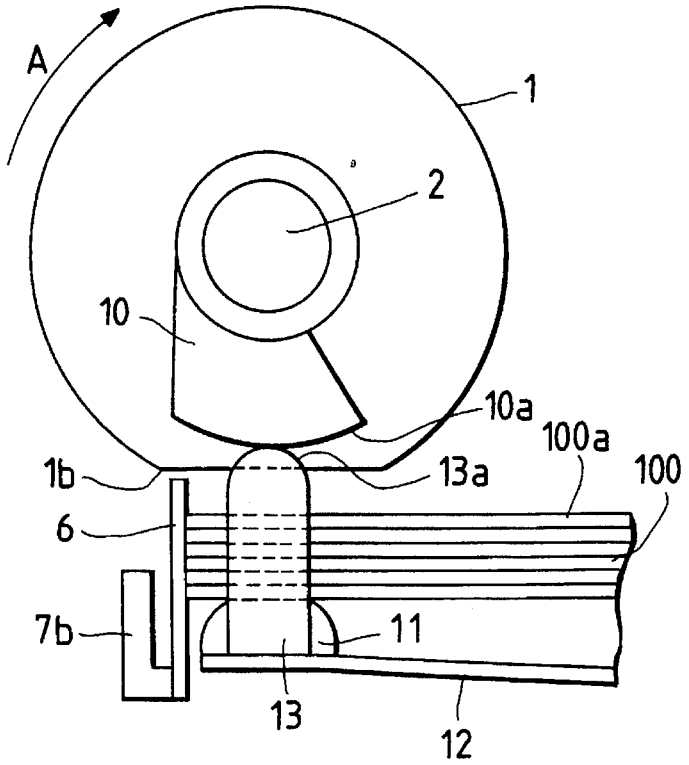
FIG. 14 is a partial side elevational view of an automatic feeding apparatus according to a second embodiment of the present invention.
Figure 15:
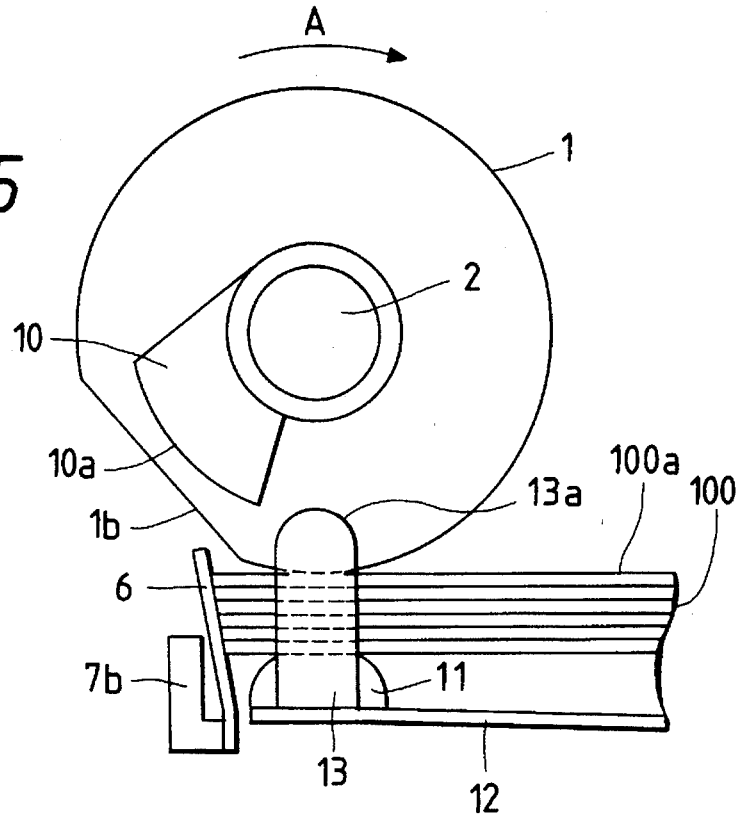
FIG. 15 is a partial side elevational view for explaining an operation of the apparatus of FIG. 14.

FIGS. 14 and 15 are elevational sectional views of a sheet feeding apparatus according to a second embodiment of the present invention. Structural elements having the same functions as those of the elements shown in the first embodiment are designated by the same reference numerals and the detailed explanation thereof will be omitted.

Sheet supply rollers 1 are the same as those shown in the first embodiment, except that they have semi-circular or D-cut shapes. In place of pulleys, push-down cams 10 are attached to respective ends of a roller shaft 2, and this roller shaft 2 is rotated in one direction (shown by the arrow A) without changing its position. Each cam 10 has a push-down portion 10*a* having a larger circular contour, and the cams are secured to respective ends of the roller shaft 2 with the same orientation or phase in such a manner that the push-down portions 10*a* of the cams are directed to the same direction as corresponding cut-out portions 1*b* of the sheet supply rollers 1.

A pressure plate 11 is secured to a free end of a pressure plate leaf spring 12 in confronting relation to the sheet supply rollers 1. The leaf spring 12 is formed from a thin plate of spring material such as a stainless steel and serves to urge a sheet stack 100 rested on the pressure plate against the sheep supply rollers 1. The other end of the leaf spring 12 is secured to a portion of a sheet deck (not shown).

Incidentally, the pressure plate 11 may be provided with slits or openings (each having a width slightly greater than that of the corresponding sheet supply roller 1) similar to those in the first embodiment so that the sheet supply rollers 1 do not slidingly contact the pressure plate 11 directly when there is no sheet on the pressure plate, thereby preventing an excessive load from acting on the motor. Pressure plate levers 13 are attached to respective lateral edges of the pressure plate leaf spring 12 and are provided at their upper ends with contact portions 13*a* which are adapted to engage with the corresponding push-down cams 10.

An operation of the sheet feeding apparatus according to the second embodiment will be explained.

In FIG. 14, normally, the cut-out portions 1*b* of the sheet supply rollers 1 are opposed to the sheet stack 100 so that the sheet supply rollers 1 do not contact the sheet stack 100.

The sheet stack 100 is regulated in all four directions (at its leading edge, trailing edge and two lateral edges), and the leading edge of the sheet stack is abutted against the separation plate 6. Now, when the sheet supply rollers 1 are rotated in a clockwise direction (direction A), the push-down cams 10 are disengaged from the pressure plate levers 13, with the result that the pressure plate 11 is shifted upwardly by the leaf spring 12, thereby urging the sheet stack 100 against the sheet supply rollers 1 (see FIG. 15). The operation for separating only the uppermost sheet 100 is the same as that shown in the first embodiment.

After the sheet supply rollers 1 are rotated in the direction A by one revolution, one cycle is completed and the condition shown in FIG. 14 is restored. In this case, although the sheet stack 100 is positioned below the sheet supply rollers 1, since the cut-out portions 1*b* of the sheet supply rollers 1 are opposed to the sheet stack, movement of the sheet stack 100 is permitted.

In this second embodiment, since the sheet supply rollers 1 are rotated without changing their positions, the contacting area (line) between the separation plate 6 and the uppermost sheet 100*a* is always constant, thus permitting stable separation of the sheet.

Next, a third embodiment of the present invention will be explained.

Figure 16:
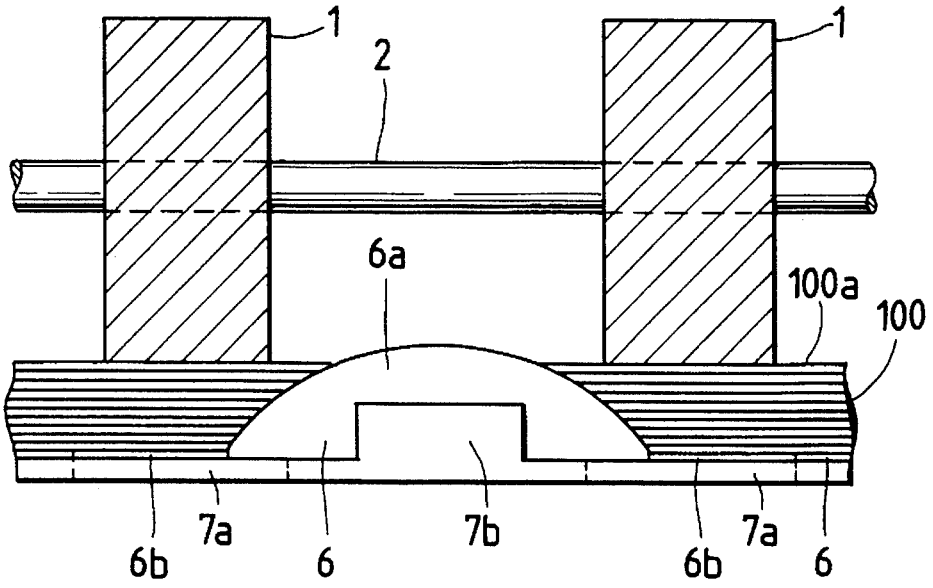
FIG. 16 is a partial and elevational view of an automatic sheet feeding apparatus according to a third embodiment of the present invention.
Figure 17:
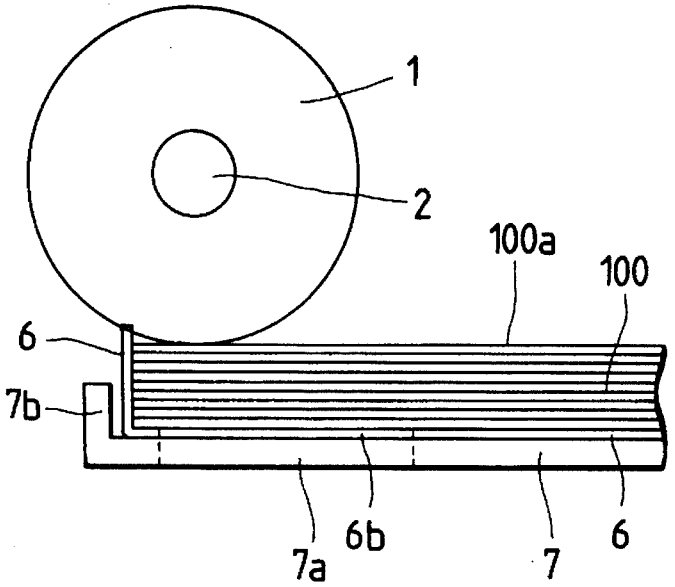
FIG. 17 is a partial side elevational view of the apparatus of FIG. 16.

FIG. 16 is a elevational end view of a sheet feeding apparatus according to a third embodiment of the present invention, and FIG. 17 is a side elevational view of the apparatus. In this third embodiment, each of sheet supply rollers 1 is made of elastic foam material such as urethane sponge l(close foams are preferable to provide the adequate elasticity), and, peripheral surfaces of the sheet supply rollers may be coated with silicone or the like to provide a high coefficient of friction. With this arrangement, when the uppermost sheet 100*a* is separated from the other sheets, the sheet supply rollers 1 can be drawn together in the axial direction due to the deformation of the sponge material without slipping with respect to the contacting sheet. Further, since the contacting areas between the sheet supply rollers and the sheet 100 are greater, the separating ability is not easily influenced by the surface condition of the sheet and/or dirt on the sheet.

Next, a fourth embodiment of the present invention will be discussed.

Figure 18:
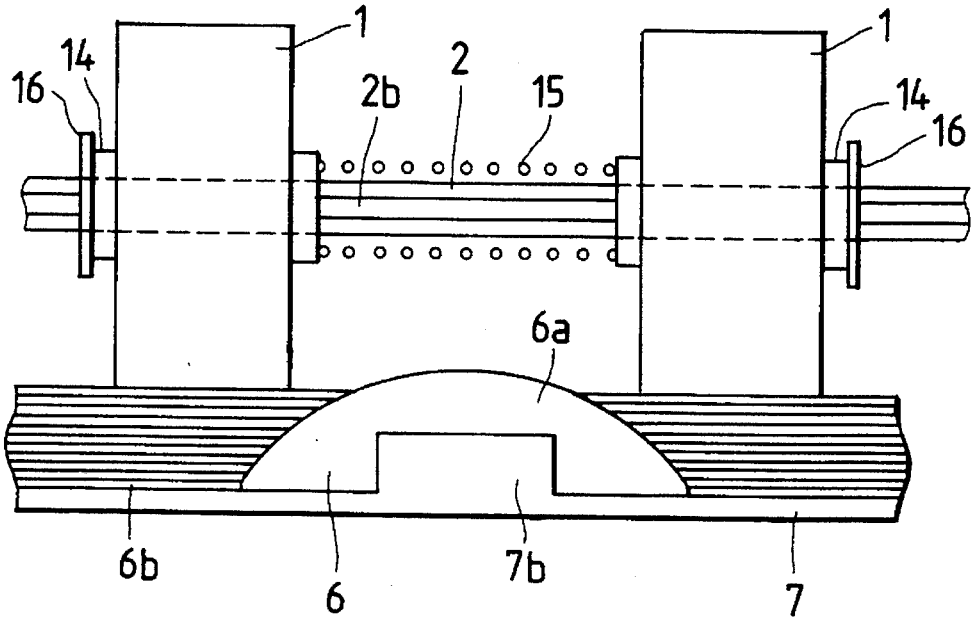
FIG. 18 is a partial and elevational view of an automatic sheet feeding apparatus according to a fourth embodiment of the present invention.
Figure 19:
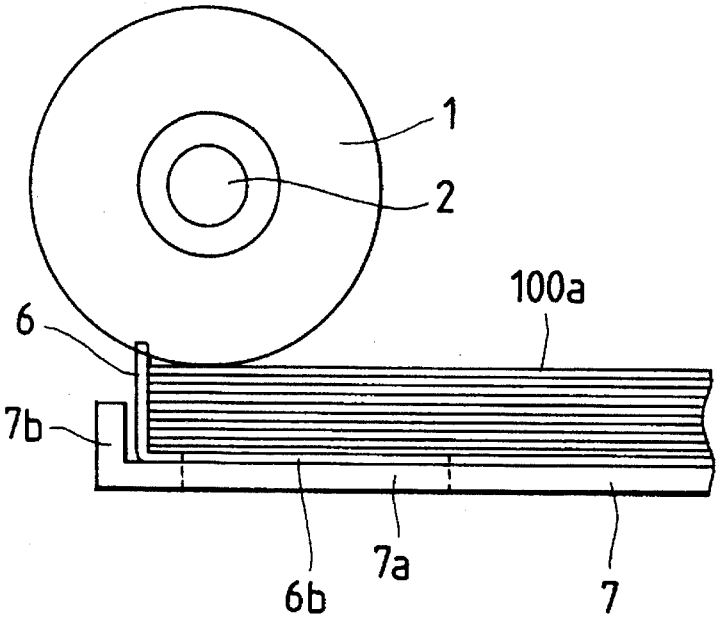
FIG. 19 is a partial and elevational view of the apparatus of FIG. 18.

FIG. 18 is an elevational end view of a sheet feeding apparatus according to a fourth embodiment of the present invention, and FIG. 19 is a side elevational view of the apparatus.

Sheet supply rollers 1 are formed as ring members which are conventionally used and which are made of rubber and the like. A keyway 2*b* having a predetermined length is formed in a roller shaft 2 along an axial direction thereof. Slide bushes 14 are mounted on the roller shaft 2 for sliding movement along the keyway, and the sheet supply rollers 1 are secured around the corresponding bushes. A compression spring 15 is disposed around the roller shaft between the bushes and serves to bias the slide bushes 14 away from each other. Stoppers 16 are secured to the roller shaft 2 at predetermined positions and serve to regulate the axial positions of the slide bushes 14 on the roller shaft. With this arrangement, the sheet supply rollers 1 can receive a rotational force from the roller shaft 2 and can also be shifted in the axial direction of the roller shaft 2.

In operation, the slide bushes 14 are shifted toward each other by the tension force of the uppermost sheet 100*a* in opposition to a biasing force of the compression spring 15, thereby separating the uppermost sheet 100*a* alone in the same manner as mentioned above.

Next, a fifth embodiment of the present invention will be explained.

Figure 20:
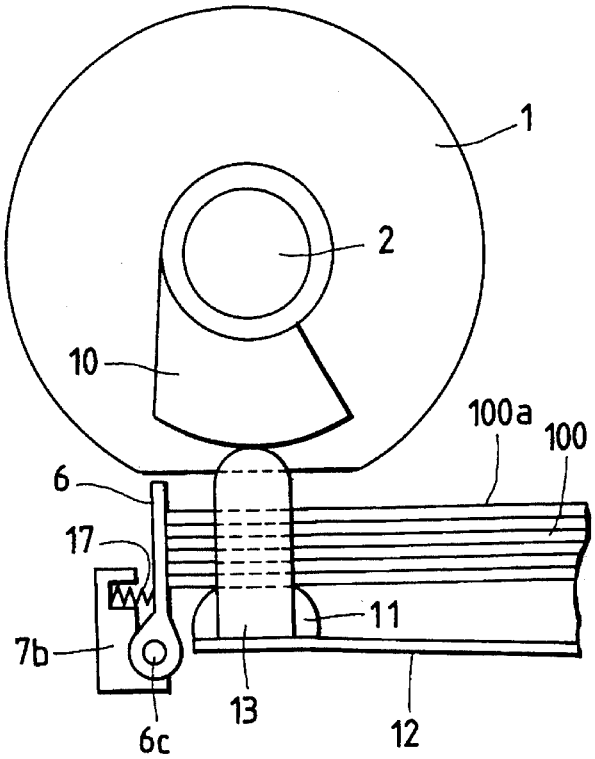
FIG. 20 is a partial side elevational view of an automatic sheet feeding apparatus according to a fifth embodiment of the present invention.
Figure 21:
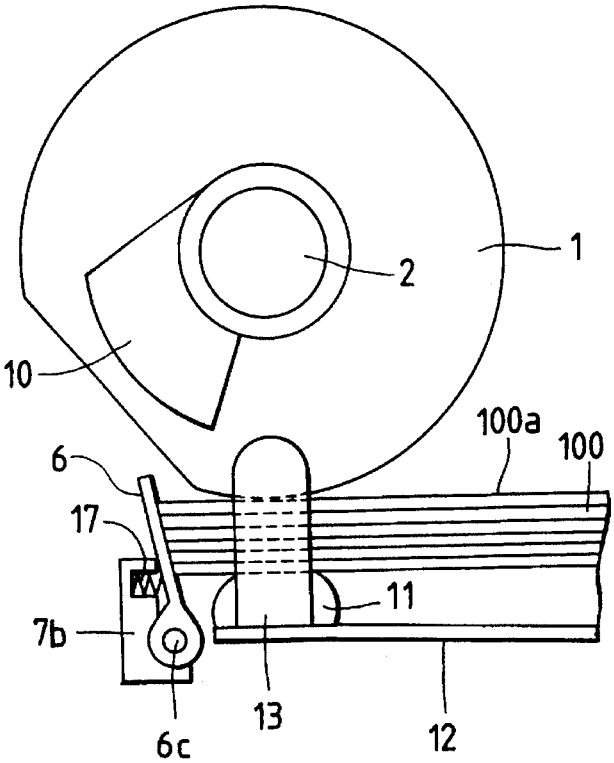
FIG. 21 is a partial side elevational view showing an operation of the apparatus of FIG. 20.

FIGS. 20 and 21 are side elevational views of a sheet feeding apparatus according to a fifth embodiment of the present invitation. This sheet feeding apparatus has the same fundamental construction as that of the second embodiment. However, in this embodiment, a separation plate 6 is formed by a rigid member having bearing portions 6*c* through which the plate is rotatably mounted on a stopper 7*b*. The separation plate is normally held in a vertical position by a separation spring (compression spring) 17. In separating the sheets, the separation plate 6 is inclined at a predetermined angle (in opposition to the separation spring), thereby facilitating the formation of the loop in the uppermost sheet 100*a*. That is to say, in the case of sheets having less resilience such as thin sheets, the separation plate 6 is inclined by a smaller angle, thereby permitting formation of a large loop in the uppermost sheet; whereas, in the case of sheets having greater resilience such as thicker sheets, the separation plate 6 is inclined more greatly, thus forming a relatively small loop in the sheet.

Next, a sixth embodiment of the present invention will be explained.

Figure 22:
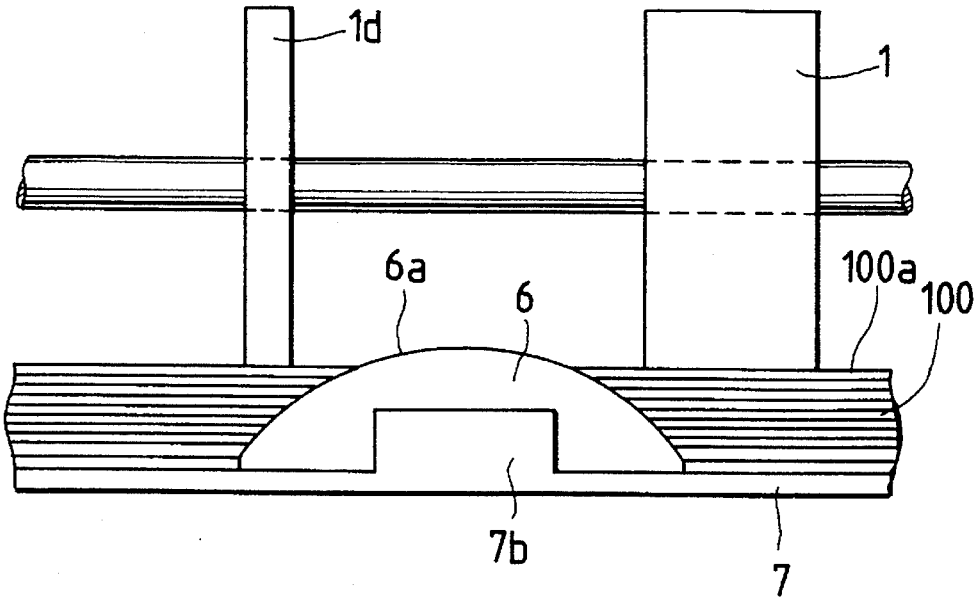
FIG. 22 is a partial end elevational view of an automatic sheet feeding apparatus according to a sixth embodiment of the present invention.
Figure 23:
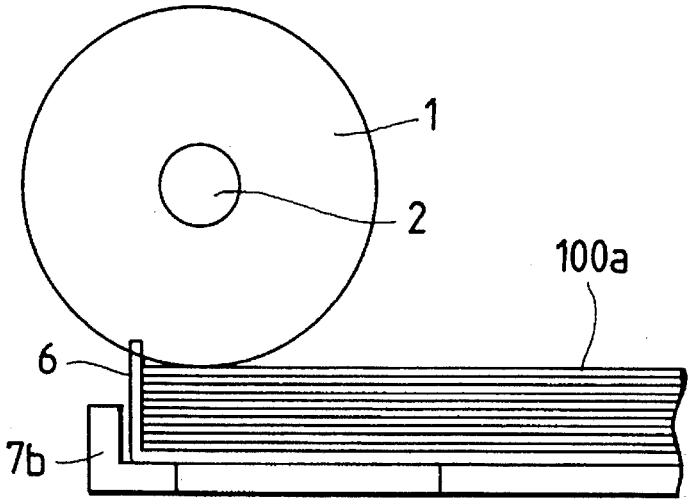
FIG. 23 is a partial side elevational view of the apparatus of FIG. 22.

FIG. 22 is an elevational end view of a sheet feeding apparatus according to a sixth embodiment of the present invention, and FIG. 23 is a side elevational view of the apparatus. A first sheet supply roller 1 is formed from a standard roller having a relatively great width and served mainly to feed the sheet. A second sheet supply roller 1*d* is formed from a thin plate-shaped member so that, in separating the sheets, the second sheet supply roller 1*d* is deformed in the axial direction to permit the formation of a loop in the uppermost sheet 100*a*. In this case, since the first sheet supply roller 1 does not shift in the axial direction, it can feed the separated sheet in parallel, thereby improving the sheet feeding ability. Further, this embodiment is particularly suitable to be used with a single-sized reference for sheet regulation. For example, in a sheet feeding apparatus wherein both sheets of A4 size and post cards can be used, when the post cards are to be separated, the position of the separation plate 6 can be adjusted so that the post cards stacked with one lateral edge thereof abutting against the side reference can be separated by the separation plate.

Next, a seventh embodiment of the present invention will be explained.

Figure 24:
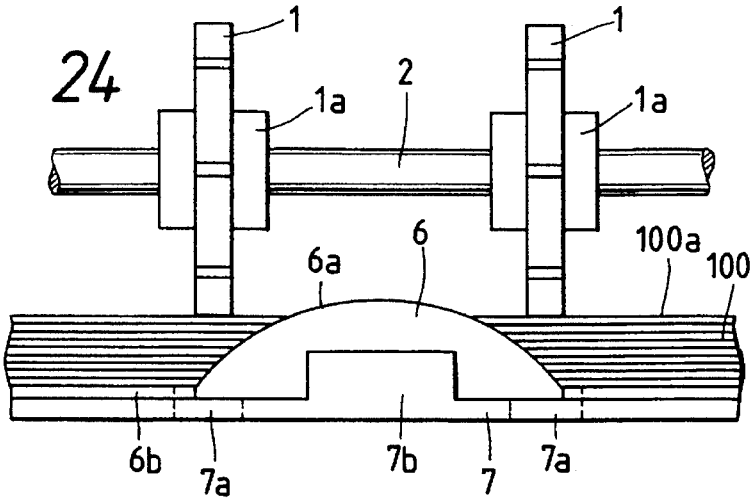
FIG. 24 is a partial end elevational view of an automatic sheet feeding apparatus according to a seventh embodiment of the present invention.
Figure 25:
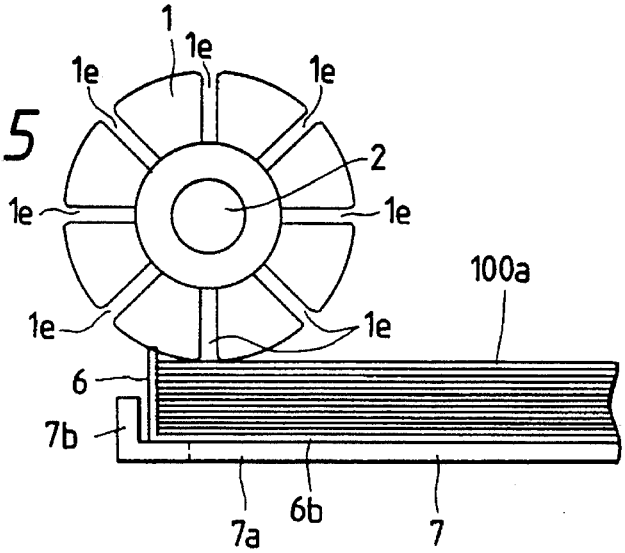
FIG. 25 is a partial side elevational view of the apparatus of FIG. 24.

FIGS. 24 and 25 show a sheet feeding apparatus according to a seventh embodiment of the present invention. In this embodiment, each of sheet supply rollers 1 is provided with a plurality of radial slits 1*e* to facilitate deformation of the sheet supply roller in an axial direction thereof. With this arrangement, the material and outer diameter of the sheet supply rollers 1 can be selected within a wider range.

Next, an eight embodiment of the present invention will be explained.

Figure 26:
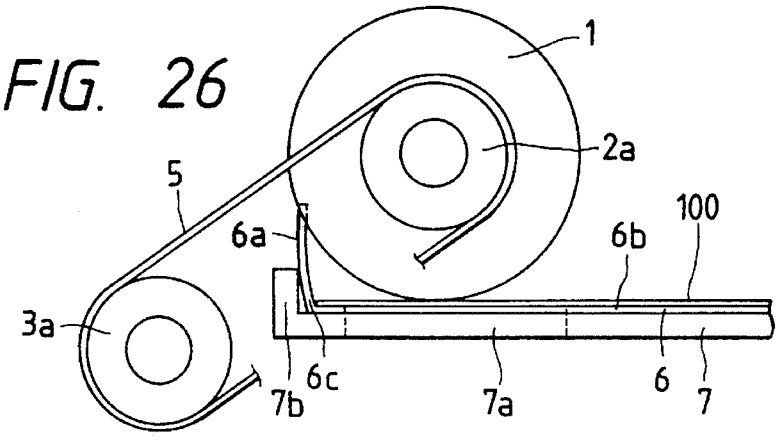
FIG. 26 is a partial side elevational view of an automatic sheet feeding apparatus according to an eighth embodiment of the present invention.

FIG. 26 is a side elevational sectional view of a sheet feeding apparatus according to an eighth embodiment of the present invention. In this embodiment, a base portion 6*c* of a separation plate 6 having an end surface 6*a* is inclined forwardly and downwardly. With this arrangement, since the base portion 6*c* of the separation plate 6 is previously inclined, even when the remaining sheets become few, the top sheet 100*a* can reliably be separated and fed out.

Figure 27:
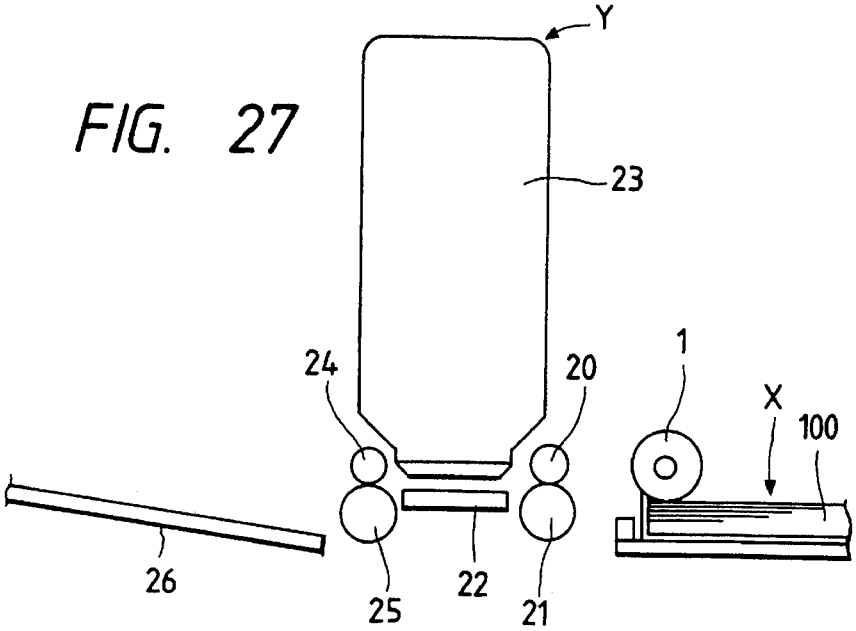
FIG. 27 is a schematic elevational view of a recording system incorporating the automatic sheet feeding apparatus of the present invention therein.
Figure 28:
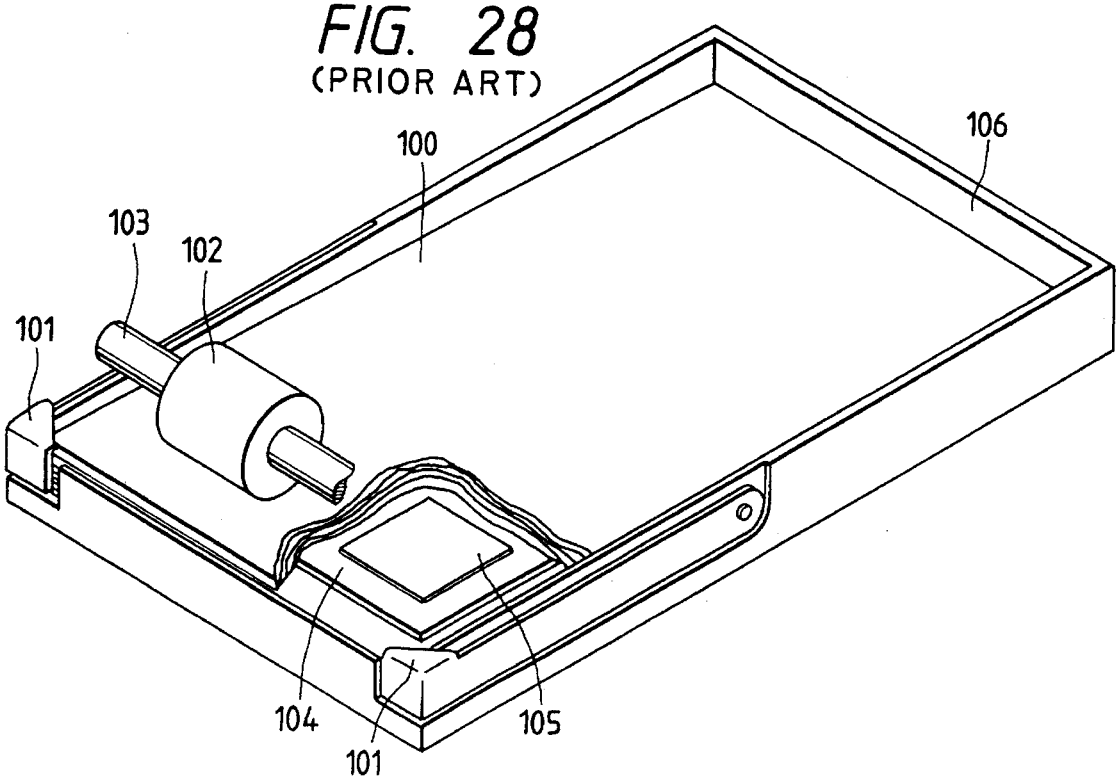
FIG. 28 (PRIOR ART)
FIG. 28 is a perspective view showing an example of a conventional sheet feeding apparatus of the claw separation type.
Figure 29:
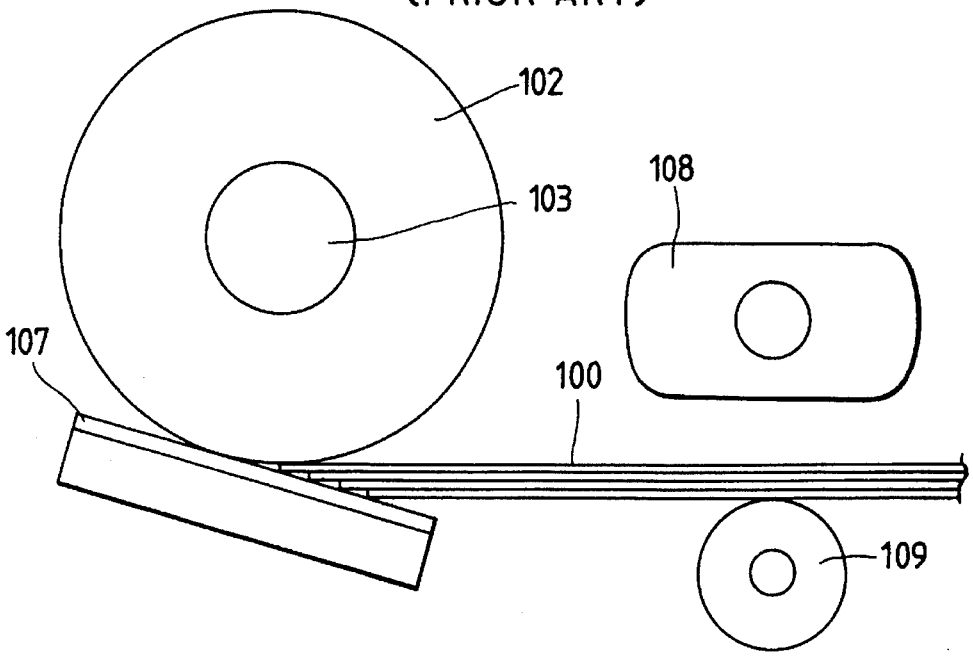
FIG. 29 (PRIOR ART)
FIG. 29 is an elevational view showing an example of a conventional sheet feeding apparatus of the friction separation type.
Figure 30:
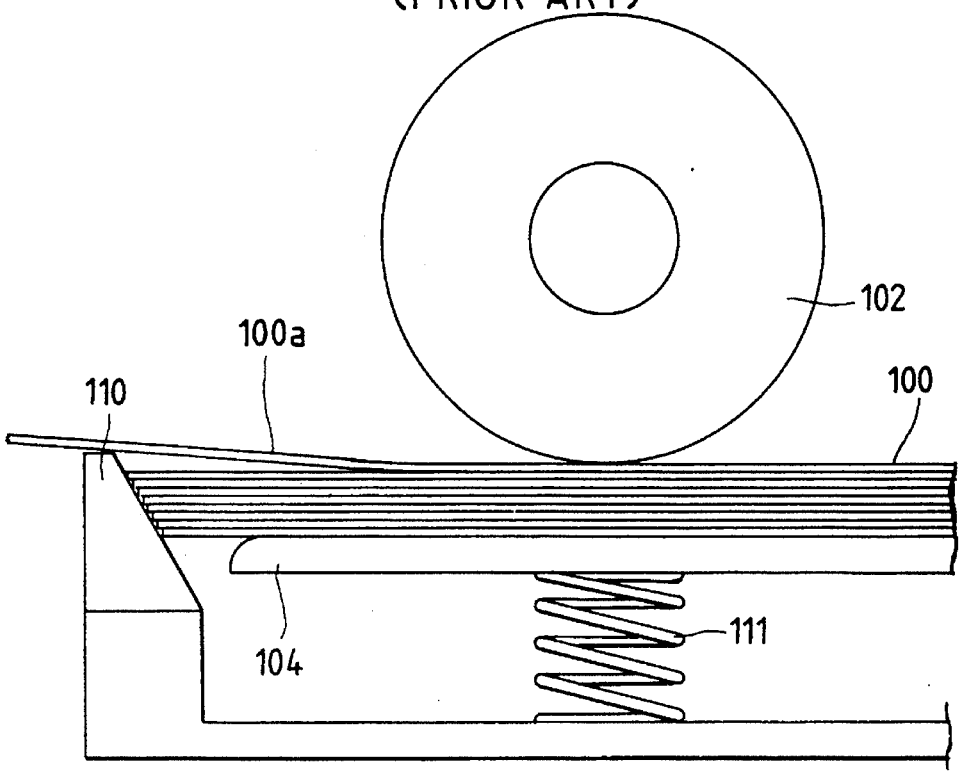
FIG. 30 (PRIOR ART)
FIG. 30 is an elevational view showing an example of a conventional sheet feeding apparatus of the bank separation type.

FIG. 27 is a schematic elevational view of a recording system into which the automatic sheet feeding apparatus of the present invention is incorporated.

The sheet 100 picked up by the automatic sheet feeding apparatus X is sent to a nip between a pinch roller 20 and a feed roller 21. The sheet 100 is further fed by the paired rollers 20, 21 to advance on a platen 22 of the recording system Y. Meanwhile, image is recorded on the sheet by a recording head 23 of the recording system in response to predetermined image information. Thereafter, the sheet on which the image was recorded is ejected onto an ejection tray 26 by a pair of ejector rollers 24, 25. The recording head 23 is formed integrally with an ink tank to constitute a replaceable ink jet recording head. The recording head 23 is provided with electrical/thermal converters so that recording is effected by selectively discharging ink from ink discharge opening(s) of the recording head by utilizing the pressure change generated by expansion and contraction of bubble(s) caused by the film boiling of the ink effected by energy applied to the selected electrical/thermal converter(s).

Incidentally, the recording type is not limited to the above-mentioned ink jet recording type, but may be of another appropriate recording type. Further, the present invention can be applied to an original feeding apparatus of an original reading system.

In the illustrated embodiments, while the separation plate was made of flexible material or was pivotally mounted and spring-biased, means for holding the separation plate at a predetermined angle is provided so that the angle of the separation plate can be manually adjusted in accordance with the thickness of the sheet.

As mentioned above, according to the present invention, since the loop permitting means permits the formation of a loop in the sheet when the sheet is riding over the separation means, it is possible to separate the sheets regardless of the thickness and material of the sheets. Thus, it is possible to separate a range of various sheets from thin sheets to thicker sheets such as post cards, envelopes and the like with a single structure. In addition, because of the simple construction, it is possible to provide a compact and inexpensive automatic sheet feeding apparatus and image forming system.

What is claimed is:

1. An automatic sheet feeding apparatus, comprising:

sheet supporting means for supporting a plurality of sheets thereon;

sheet supply means for feeding out sheets supported by said sheet supporting means; and separation means, including a semi-circular plate member disposed downstream of said sheet supply means, for causing one of the sheets fed by said sheet supply means to flex and ride over the semi-circular plate member of said separation means, thereby to separate the sheets one by one;

wherein said sheet supply means comprises a plurality of rotary sheet supply members, and at least one of said rotary sheet supply members is elastically deformable to follow a flexure of the sheet generated when the sheet fed by said sheet supply means is riding over the semicircular plate member of said separation means.

2. An automatic sheet feeding apparatus according to claim 1, wherein a portion of said at least one rotary sheet supply member which is contacted to said one sheet is made of flexible material so that said portion is deformed in response to the flexure of the sheet.

3. An automatic sheet feeding apparatus according to claim 1, wherein a portion of said sheet supply means which is contacted with the sheet is made of foam material so that said portion of the foam material can deform in response to the flexion of the sheet.

4. An automatic sheet feeding apparatus according to claim 1, wherein said sheet supply means has a rotary sheet supply member for feeding out the sheet by its rotation while abutting against the sheet, and said rotary sheet supply member is slidable along its rotation axis so that said rotary sheet supply member can be slidingly shifted in response to the flexion of the sheet.

5. An automatic sheet feeding apparatus according to claim 4, further comprising an elastic member for returning the shifted rotary sheet supply member to its original sheet feeding position.

6. An automatic sheet feeding apparatus according to claim 1, wherein said sheet supply means comprises a disk-shaped sheet supply roller, and said sheet supply roller is provided with a plurality of radial slits so that said roller can be deformed in response to the flexion of the sheet.

7. An automatic sheet feeding apparatus according to claim 1, wherein said rotary sheet supply members are disposed on left and right sides of said separation means substantially in parallel with respective leading edges of the sheets.

8. An automatic sheet feeding apparatus according to claim 1, wherein said at least one rotary sheet supply member is pivotally supported around a fulcrum arranged in the vicinity of said separation means and is adapted to feed out said one sheet and said at least one rotary sheet supply member is abutted against the sheets at a substantially constant position from said semi-circular plate member regardless of the amount of sheets supported on said sheet supporting means.

9. An automatic sheet feeding apparatus according to claim 8, further comprising transmission means for transmitting a driving force to said at least one rotary sheet supply member via said fulcrum, whereby, a driving force in a sheet feeding direction is transmitted to said at least one rotary sheet supply member by said transmission means, said at least one rotary sheet supply member is pivoted in a direction in which said at least one rotary sheet supply member is abutted against the sheets, and, when a driving force in a direction opposite the sheet feeding direction is transmitted to said at least one rotary sheet supply member, said at least one rotary sheet supply member is pivoted in a direction in which said at least one rotary sheet supply member is separated from the sheets.

10. An automatic sheet feeding apparatus according to claim 1, wherein said sheet supporting means has a support plate for biasing the sheets toward said sheet supply means, and spacing means is provided between said sheet supply means and said support plate to space said support plate apart from said sheet supply means in opposition to a biasing force of said support plate.

11. An automatic sheet feeding apparatus according to claim 10, wherein said spacing means comprises a cam provided on one of said sheet supply means and said support plate, and a lever provided on the other of said sheet supply means and said support plate.

12. An automatic sheet feeding apparatus, comprising:

sheet supporting means for supporting a plurality of sheets thereon;

sheet supply means for feeding out sheets supported by said sheet supporting means;

a semi-circular plate member inclinably mounted for abutting leading edges of sheets fed out by said sheet supplying means, for separating the sheets one by one by causing one of the sheets fed by said sheet supply means to ride over said semi-circular plate member, an inclination angle of the semi-circular plate member varying in accordance with a force applied by leading edges of the sheets fed by said sheet supply means;

wherein said sheet supply means is elastically deformable to follow a flexure of a sheet produced when said sheet is riding over said semi-circular plate member.

13. An automatic sheet feeding apparatus according to claim 12, wherein the inclination angle of said semi-circular plate member increases as the force increases.

14. An automatic sheet feeding apparatus according to claim 13, wherein said semi-circular plate member is a thin elastic plate, said plate being elastically deformed and inclined when the sheets abut against said plate.

15. An automatic sheet feeding apparatus according to claim 13, wherein said separation means comprises a pivotable plate, and an elastic member for biasing said plate, whereby said plate is inclined in opposition to an elastic force of said elastic member when the sheets abut against said plate.

16. An automatic sheet feeding apparatus according to claim 13, further comprising a stopper for preventing said separation plate from being inclined by more than a predetermined angle.

17. A recording system, comprising:

sheet supporting means for supporting a plurality of sheets thereon;

sheet supply means for feeding out sheets supported by said sheet supporting means;

separation means, including a semi-circular plate member disposed downstream of said sheet supply means, for causing one of the sheets fed by said sheet supply means to flex and ride over the semi-circular plate member, thereby to separate the sheets one by one; and recording means for recording an image on a sheet separated one by one by said separation means;

wherein said sheet supply means comprises a plurality of rotary sheet supply members, and at least one of said rotary sheet supply members is elastically deformable to follow a flexure of the sheet generated when said one sheet is riding over the semi-circular plate member of said separation means.

18. A recording system according to claim 17, wherein said recording means is an ink jet apparatus, in which recording is effected by selectively discharging ink from discharge openings by expansion of bubbles caused by heating the ink to a temperature exceeding a film boiling temperature of the ink by means of electrical/thermal converters.

19. A recording system, comprising:

sheet supporting means for supporting a plurality of sheets thereon;

sheet supply means for feeding out sheets supported by said sheet supporting means;

a semi-circular plate member inclinably mounted for abutting leading edges of sheets fed out by said sheet supply means, for separating the sheets one by one by causing a sheet to ride over said semi-circular plate member; and recording means for recording an image on a sheet separated by said separation means;

wherein said sheet supply means is elastically deformable to follow a flexure of a sheet generated when the sheet fed by said sheet supply means is riding over the semicircular plate member of said separating means.

20. A recording system according to claim 19, wherein said recording means is an ink jet apparatus, in which recording is effected by selectively discharging ink from discharge openings by expansion of bubbles caused by heating the ink to a temperature exceeding a film boiling temperature of the ink by means of electrical/thermal converters.

21. An automatic sheet feeding apparatus, comprising:

sheet supporting means for supporting a plurality of sheets thereon, rotary sheet supply means for feeding out sheets supported by said sheet supporting means, by applying a rotary drive force to the sheets; and separation means, including a semicircular plate member, for separating sheets fed out by said rotary sheet supply means one by one by causing a sheet fed by said rotary sheet supply means to flex and ride over the semicircular plate member, an inclination angle of the semi-circular plate member varying in accordance with a force applied by leading edges of sheets fed by said rotary sheet supply means;

wherein said rotary sheet supply means is disposed at a position corresponding to a location of a flexure of a sheet produced by said semi-circular plate member and is deformable to follow the flexure of said sheet so as not to apply any substantial force other than the rotary drive force.

22. A recording system, comprising:

sheet supporting means for supporting a plurality of sheets thereon;

rotary sheet supply means for feeding out sheets supported by said sheet supporting means, by applying a rotary drive force to the sheets;

separation means, including a semi-circular plate member, for separating sheets one by one by causing a sheet fed by said rotary sheet supply means to flex and ride over said semi-circular plate member; and recording means for recording an image on a sheet separated by said separation means;

wherein said rotary sheet supply means is disposed at a position corresponding to a location of a flexure by said separation means, and is deformable to follow a flexure of said sheet so as not to apply any substantial force other than the drive force.

23. An automatic sheet feeding apparatus according to claim 1, wherein said separation means comprises a thin elastic plate to be elastically deformed and inclined, when a sheet is abutted against said plate.

24. An automatic sheet feeding apparatus according to claim 1, wherein said semi-circular plate member is disposed at a position corresponding to a substantially central portion of leading edges of sheets supported by said sheet supporting means.

25. An automatic sheet feeding apparatus comprising:

sheet supporting means for supporting a plurality of sheets thereon;

sheet supply means for feeding out sheets supported by said sheet supporting means; and separation means, including a semi-circular plate disposed downstream of said sheet supply means, for separating sheets fed out by said sheet supply means, sheets fed out by said sheet supply means riding over the semi-circular plate thereby being separated one by one;

wherein said sheet supply means includes a plurality of rotary sheets supply members, and wherein one of said rotary sheet supply members follows a flexure of a sheet produced when the sheet is riding over the semi-circular plate.

26. An automatic sheet feeding apparatus according to claim 25, wherein said semi-circular plate is disposed at a position corresponding to a substantially central portion of leading edges of sheets supported by said sheet supporting means.

27. A recording system, comprising:

sheet supporting means for supporting a plurality of sheets thereon;

sheet supply means for feeding out sheets supported by said sheet supporting means;

separation means, including a semi-circular plate disposed downstream of said sheet supply means, for separating sheets fed by said sheet supply means, sheets fed out by said sheet supply means riding over the semi-circular plate thereby being separated one by one; and recording means for recording an image on a sheet separated one by one by said separation means;

wherein said sheet supply means includes a plurality of rotary sheet supply members, and wherein one of said rotary sheet supply members follows a flexure of a sheet generated when the sheet is riding over the semi-circular plate.

* * * * *

UNITED STATES PATENT AND TRADEMARK OFFICE

CERTIFICATE OF CORRECTION

PATENT NO. : 5,485,991
DATED : January 23, 1996
INVENTOR(S) : HIROFUMI HIRANO, ET AL.

It is certified that error appears in the above-indentified patent and that said Letters Patent is hereby corrected as shown below: Title page, col. 2, Item [57] ABSTRACT:
line 1, "The present invention provides an" should read --An--;
line 2, "comprising" should read --includes--;
line 6, "sheet" should read --sheets--; and
line 8, "apply" should read --apply a--.

Column 1,
line 24, "the" should read --with the--.

Column 3,
line 10, "form" should read --for--.

Column 8,
line 3, "l(close" should read --(close--.

Column 9,
line 26, "eight" should read --eighth--.

Column 10,
line 65, "one sheet" should read --one sheet,--.

Column 12,
line 46, "thereon," should read --thereon;--; and
line 60, "member" should read --member,--.

Signed and Sealed this

Second Day of July, 1996

Bruce Lehman

*Attest:*

BRUCE LEHMAN

*Attesting Officer*

*Commissioner of Patents and Trademarks*